US007837605B2

(12) United States Patent
Wu

(10) Patent No.: US 7,837,605 B2
(45) Date of Patent: Nov. 23, 2010

(54) ANKLE-CLAMPING DEVICE FOR AN INVERSION TABLE

(76) Inventor: Chieh-Ming Wu, No. 6, Lane 4-30, Chuan-Chou Rd., Hou-Li Hsiang, Taichung Hsien (TW)

( * ) Notice: Subject to any disclaimer, the term of this patent is extended or adjusted under 35 U.S.C. 154(b) by 456 days.

(21) Appl. No.: 12/062,560

(22) Filed: Apr. 4, 2008

(65) Prior Publication Data

US 2009/0249589 A1 Oct. 8, 2009

(51) Int. Cl.
*A63B 21/00* (2006.01)

(52) U.S. Cl. ..... 482/143; 482/144

(58) Field of Classification Search ..... 482/143, 482/144; 601/98, 34, 99; 81/57.16
See application file for complete search history.

(56) References Cited

U.S. PATENT DOCUMENTS 4,905,676 A * 3/1990 Bond et al. ..... 601/34
7,507,192 B2 * 3/2009 Teeter et al. ..... 482/144
7,575,541 B2 * 8/2009 Chen ..... 482/144
2009/0314137 A1 * 12/2009 Perez ..... 81/57.16

* cited by examiner

*Primary Examiner*—Jerome W. Donnelly
(74) *Attorney, Agent, or Firm*—Shook, Hardy & Bacon L.L.P.

(57) ABSTRACT

An ankle-clamping device for an inversion table includes a clamp holder, a motor mounted on the clamp holder, a worm shaft rotated by the motor, and a clamping roller unit that includes a worm gear connected rotatably to the clamp holder and meshing with the worm shaft, a lever having one end connected to and rotatable along with the worm gear, a pair of fixed clamping rollers fixed to the clamp holder, and a pair of movable clamping rollers fixed to the lever. The movable clamping rollers are movable toward or away from the fixed clamping rollers to cooperatively clamp therebetween or to permit release of the user's ankles from therebetween, respectively.

4 Claims, 7 Drawing Sheets

ANKLE-CLAMPING DEVICE FOR AN INVERSION TABLE

BACKGROUND OF THE INVENTION

1. Field of the Invention

This invention relates to an ankle-clamping device, more particularly to an ankle-clamping device for an inversion table.

2. Description of the Related Art

Referring to FIGS. 1 to 3, an inversion table 1 is shown to incorporate a conventional ankle-clamping device 13, and includes a support frame 11 and a backboard 12 connected pivotally to the support frame 11. The ankle-clamping device 13 includes an extendable bar 131 connected to the backboard 12, two spaced-apart positioning plates 14 connected respectively to two opposite sides of the extendable bar 131 at a front end thereof, two foot rests 141 connected respectively to the positioning plates 14, and a clamping roller unit 15. The clamping roller unit 15 includes a tubular lever 151 movable relative to the extendable bar 131, two parallel coupling plates 1511 integrally connected to a front end of the lever 151 and connected pivotally to and disposed between the positioning plates 14, a slide cover 1512 fixed to the coupling plates 1511 and disposed movably between the positioning plates 14, a ratchet plate 152 fixed between the positioning plates 14 and having a plurality of ratchet teeth 153, a mandrel 155 inserted movably into the lever 151 and having a bottom end provided with a pawl 154 that is connected pivotally between the positioning plates 14 and that is engaged removably to one of the ratchet teeth 153, a hollow head 156 fixed to a top end of the lever 151 and surrounding a top end of the mandrel 155, a control knob 158 disposed on top of the mandrel 155 within the head 156, and a spring 159 to bias the control knob 158 outwardly. The clamping roller unit 15 further includes a pair of fixed clamping rollers 160 fixed respectively to two opposite sides of the bar 131, and a pair of movable clamping rollers 160' connected respectively to the coupling plates 1511 and movable along with the lever 151. By operating the lever 151 manually, the movable clamping rollers 160' are moved toward the fixed clamping rollers 160 so as to cooperate with the same to clamp and position the user's ankles therebetween, or away from the fixed clamping rollers 160 so as to permit release of the user's ankles from therebetween.

To adjust an inclination angle of the lever 151 relative to the bar 131 so as to move the movable clamping rollers 160' toward or away from the fixed clamping rollers 160, the control knob 158 is first pressed to compress the spring 159 and force the mandrel 155 to move downwardly so as to pivot the pawl 154 away from the ratchet plate 152 (see FIG. 3). As such, the lever 151 can be moved adjustably relative to the bar 131. When the control knob 158 is released, through a restoring action of the spring 159, the control knob 158 is biased outwardly by the spring 159, and the pawl 154 is pivoted to engage again the ratchet plate 152 (see FIG. 2), thereby positioning the lever 151 at the desired inclination angle.

Although the conventional ankle-clamping device 13 for the inversion table 1 can achieve its intended purpose, it has the following drawbacks:

1. The control knob 158 and the lever 151 are operated manually, so that the clamping roller unit 15 is inconvenient to use.

2. The clamping roller unit 15 employs many components, so that not only is the assembly of the clamping roller unit 15 complicated, the manufacturing time and costs of the entire inversion table 1 are also increased.

SUMMARY OF THE INVENTION

Therefore, the object of the present invention is to provide an ankle-clamping device for an inversion table that can be operated electrically and that has few components so as to be quickly and easily assembled.

According to this invention, an ankle-clamping device for an inversion table comprises a clamp holder, a drive mechanism, and a clamping roller unit. The drive mechanism includes a motor mounted on the clamp holder, and a worm shaft rotated by the motor. The clamping roller unit includes a worm gear connected rotatably to the clamp holder and meshing with the worm shaft, a lever having one end connected to and rotatable along with the worm gear, a pair of fixed clamping rollers fixed to the clamp holder, and a pair of movable clamping rollers fixed to the lever. The movable clamping rollers are movable toward the fixed clamping rollers to cooperatively clamp therebetween the user's ankles, or away from the fixed clamping rollers to permit release of the user's ankles from therebetween.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
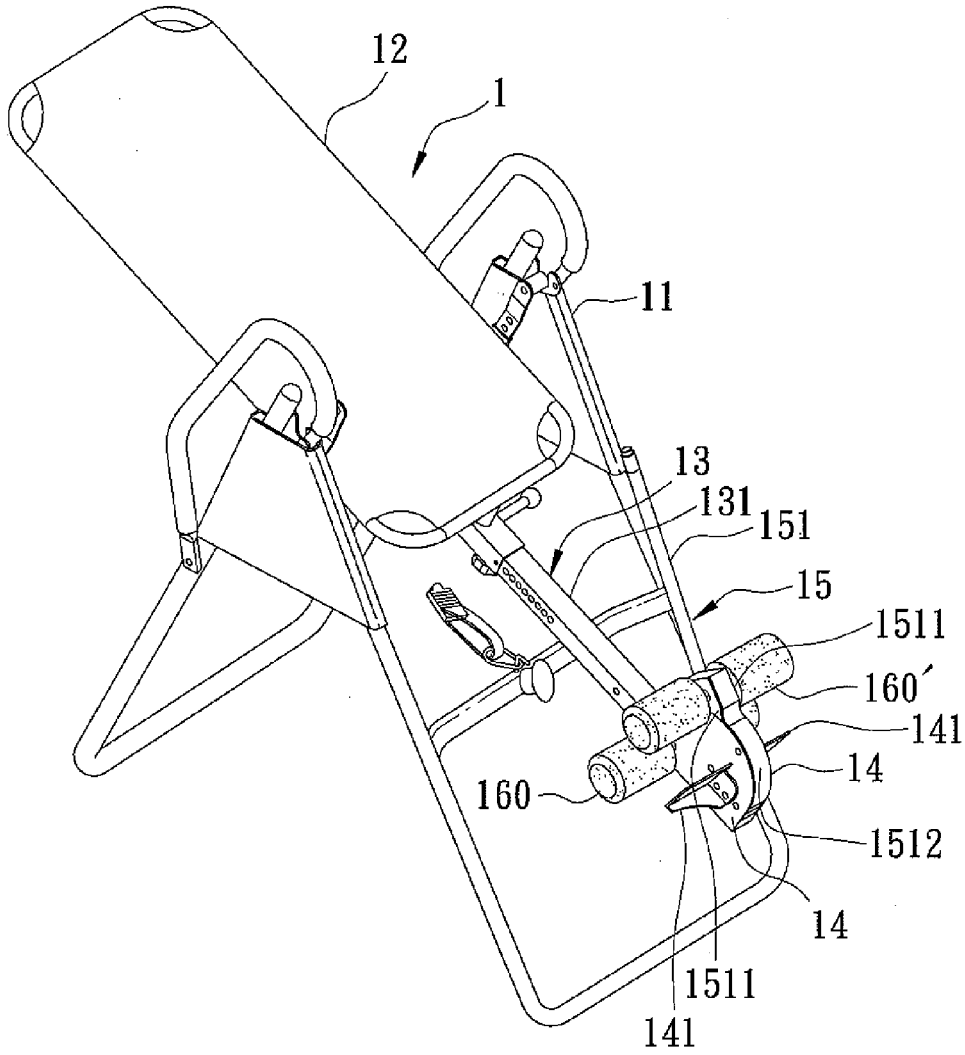
FIG. 1 PRIOR ART
FIG. 1 is a perspective view of an inversion table incorporating a conventional ankle-clamping device.
Figure 2:
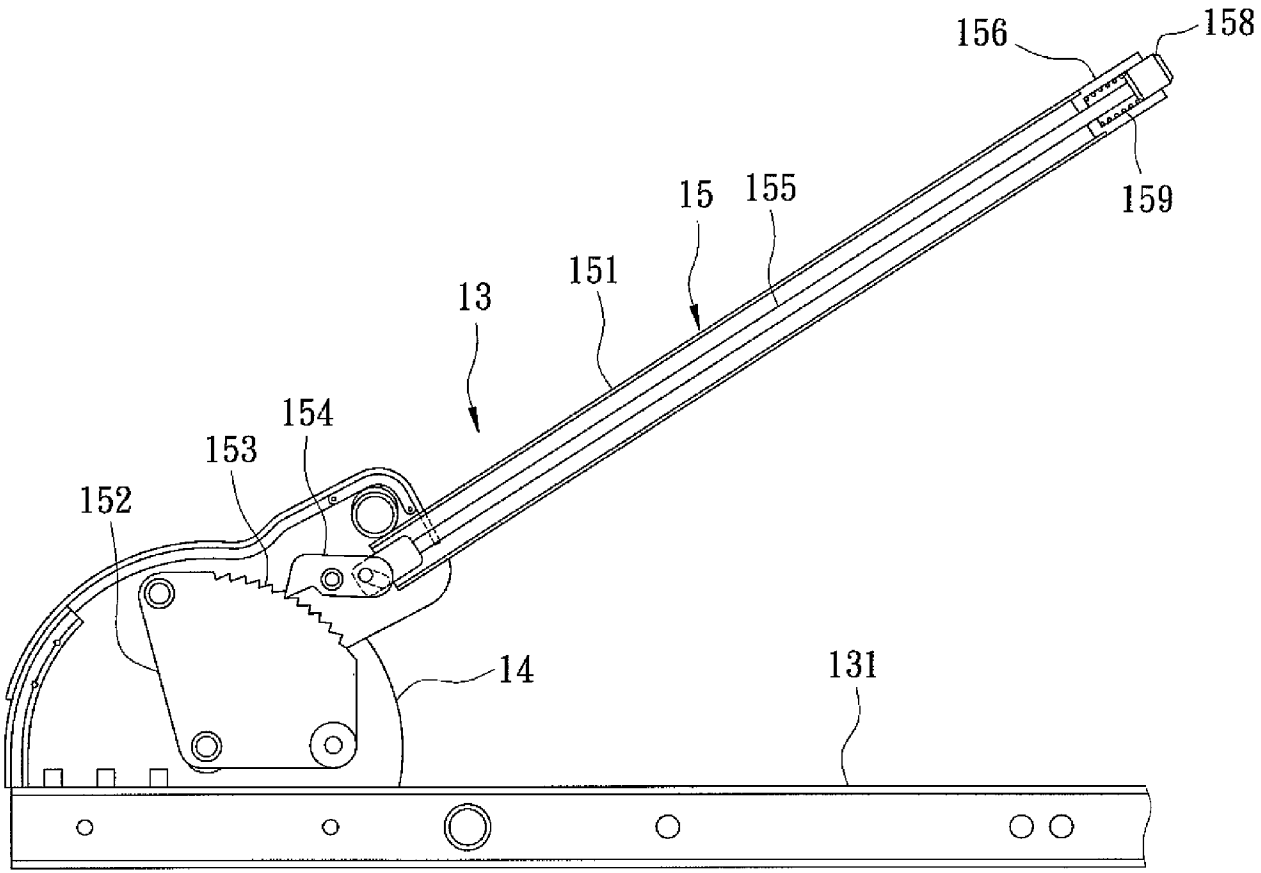
FIG. 2 PRIOR ART
FIG. 2 is a fragmentary sectional view of the conventional ankle-clamping device, illustrating a pawl engaged to a ratchet plate.
Figure 3:
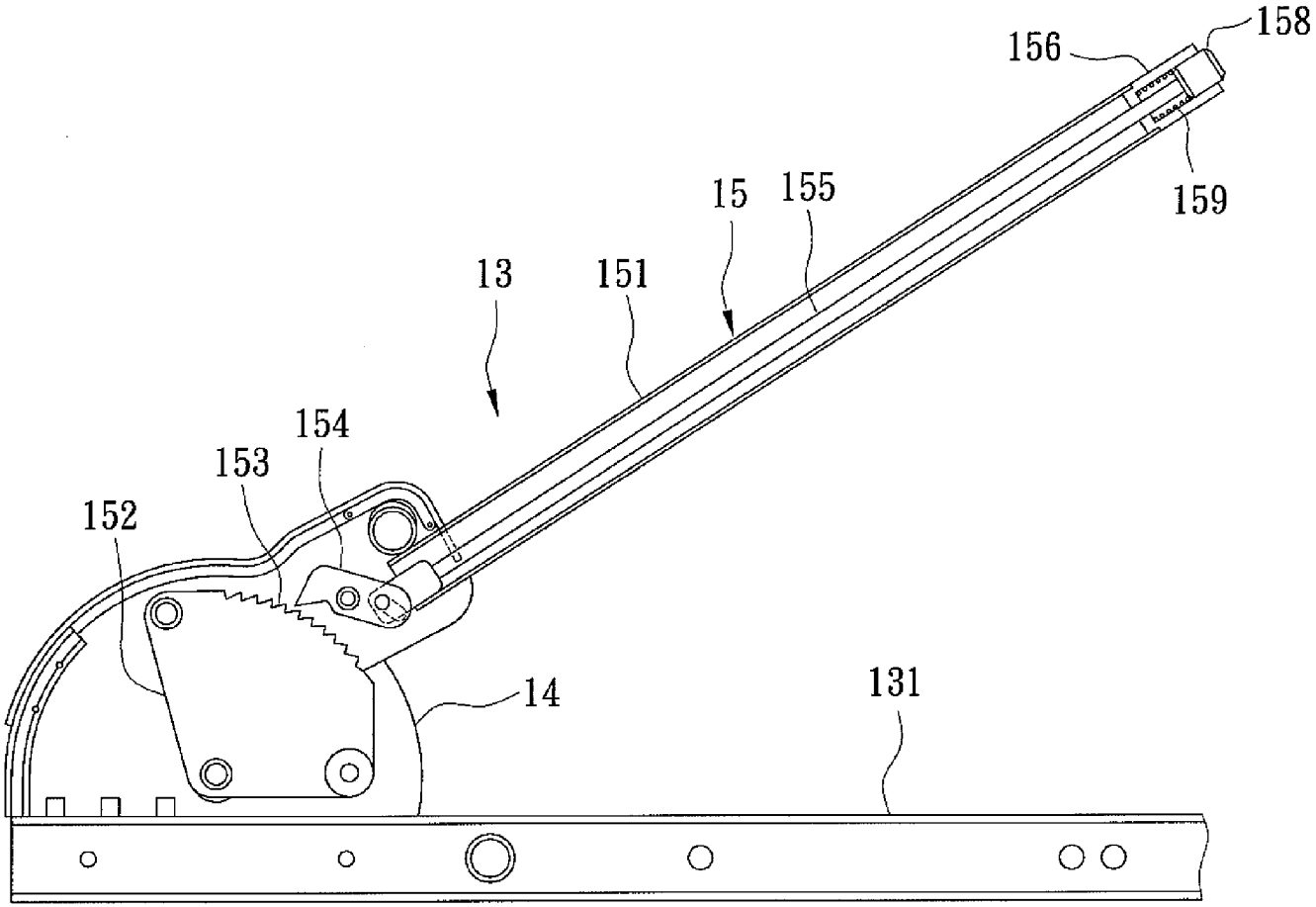
FIG. 3 PRIOR ART
FIG. 3 is a view similar to FIG. 2, but illustrating the pawl pivoting away from the ratchet plate.

Referring to FIGS. 4 to 7, an ankle-clamping device 2 according to the preferred embodiment of the present invention is adapted to be incorporated in an inversion table 1 shown in FIG. 1, and is shown to comprise a clamp holder 3, a drive mechanism 4, a clamping roller unit 5, and a push member 6.

The clamp holder 3 includes an extendable bar 31, and two positioning plates 32 connected respectively to two opposite sides of the bar 31 at a front end thereof and cooperating with the bar 31 to define a receiving space 33.

The drive mechanism 4 includes a motor 41 disposed in the receiving space 33, a worm shaft 42 driven by the motor 41 to rotate, and a mounting seat 43 fulcrumed to and disposed between the positioning plates 32 through a pivot pin 44 for supporting the motor 41.

The clamping roller unit 5 includes a worm gear 51 connected rotatably to and disposed between the positioning plates 32 through a spindle 510 and meshing with the worm shaft 42, a lever 53 having one end welded to a coupler 511 that is sleeved fixedly around the spindle 510 and rotatable along with the worm gear 51, a pair of fixed clamping rollers 52 fixed respectively to two opposite sides of the bar 31, and a pair of movable clamping rollers 52' fixed to another end of the lever 53 that is distal from the worm gear 51 and projecting oppositely from the lever 53.

Figure 4:
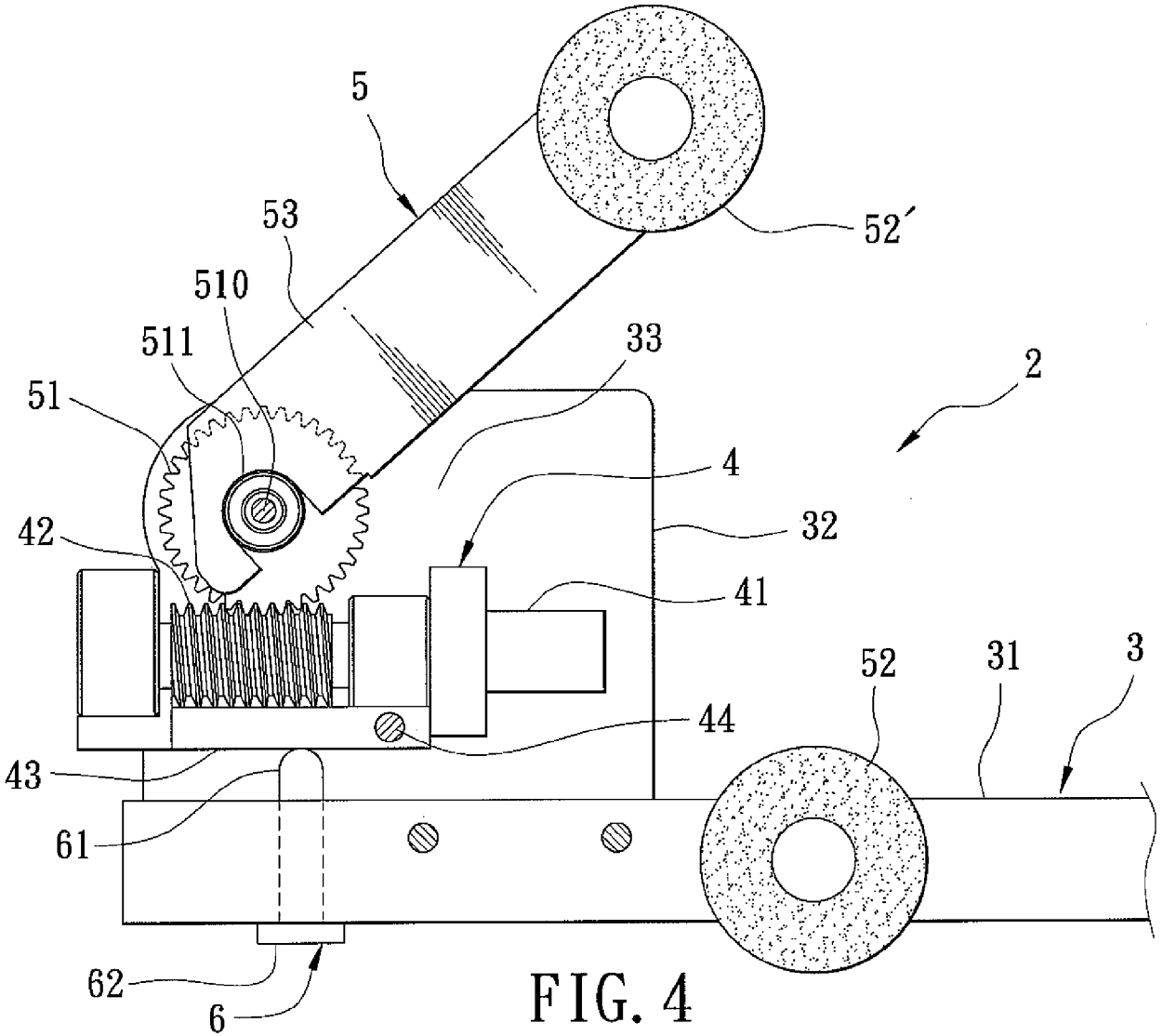
FIG. 4 is a fragmentary sectional view of an ankle-clamping device according to the preferred embodiment of this invention.
Figure 5:
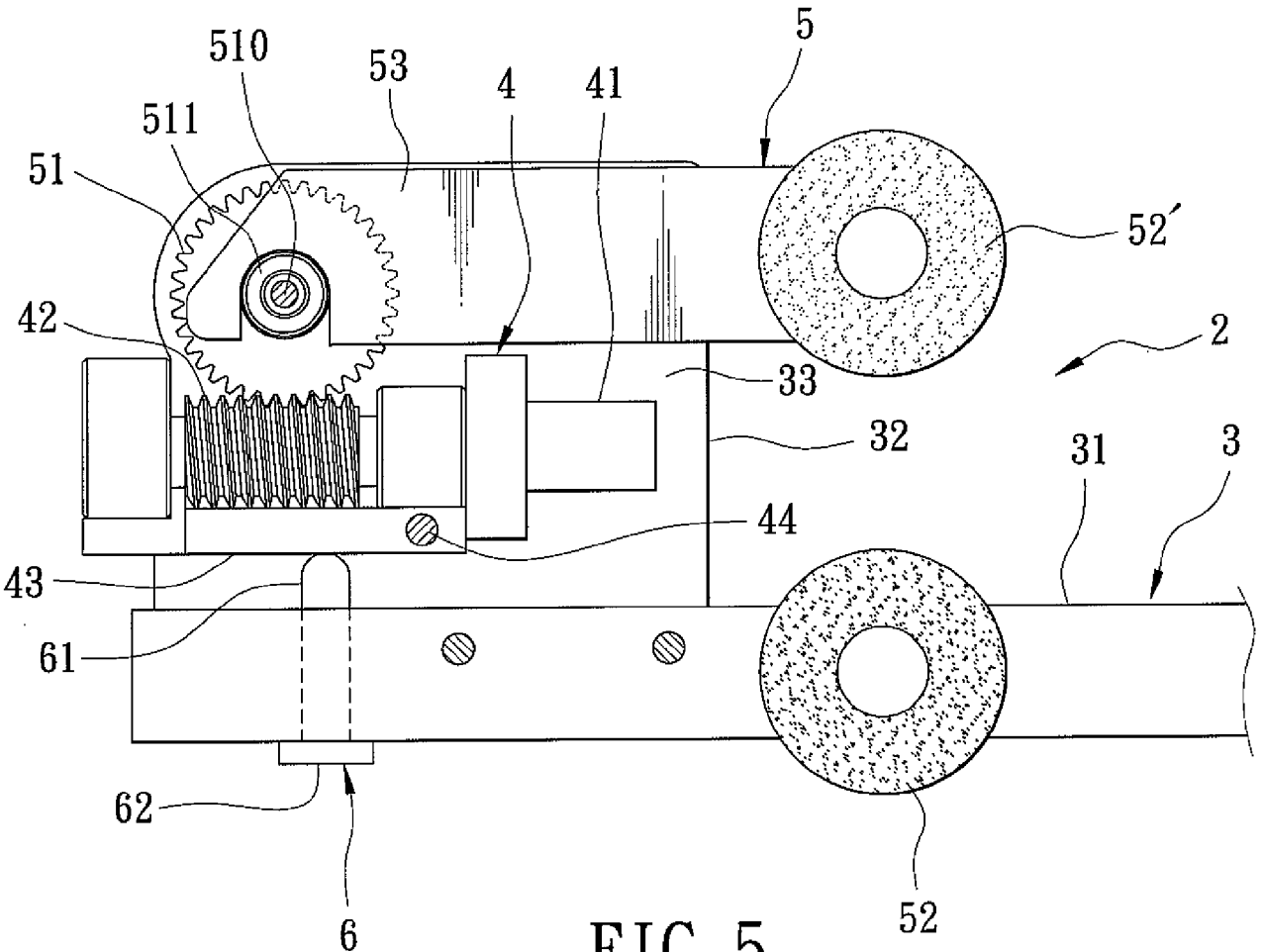
FIG. 5 is a view similar to FIG. 4, but illustrating a lever pivoting downwardly relative to a bar.
Figure 6:
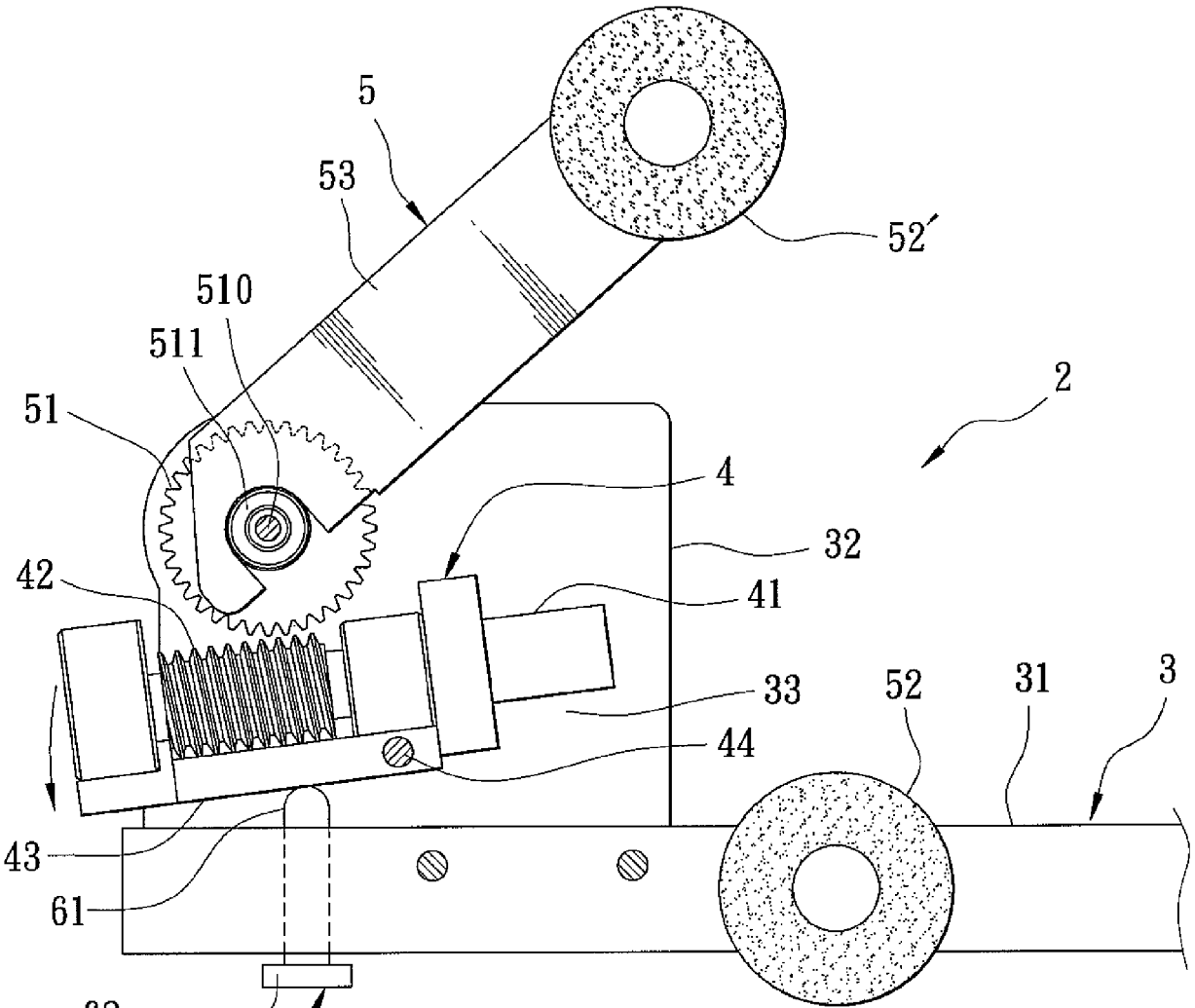
FIG. 6 is a view similar to FIG. 4, but illustrating a worm shaft being moved away from a worm gear.
Figure 7:
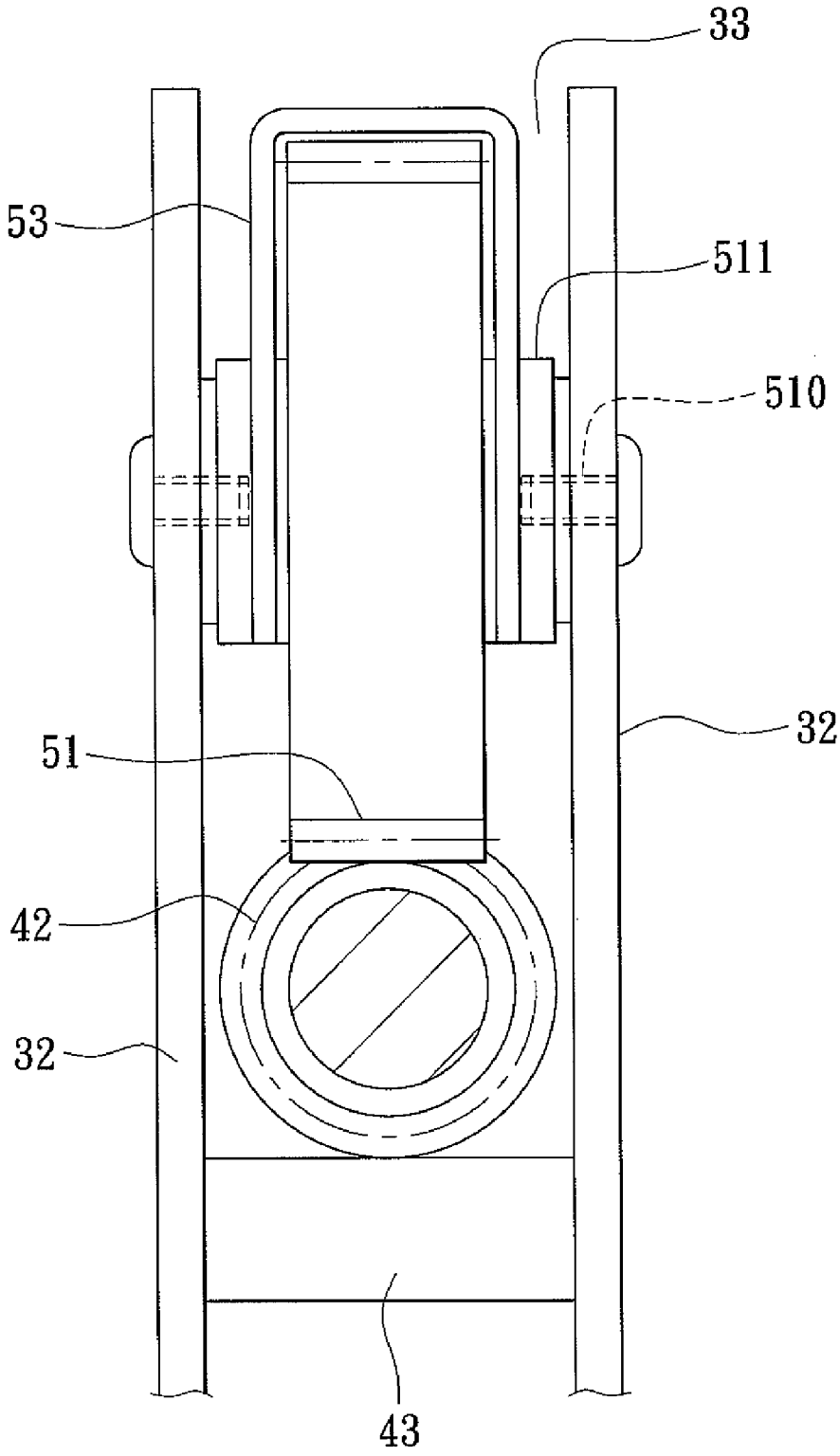
FIG. 7 is a fragmentary schematic view of the preferred embodiment, illustrating connection between the lever and the worm gear.

The push member 6 is configured as a bolt, which is connected threadedly and movably to the bar 31, and has one end 61 abutting against a bottom face of the mounting seat 43, and another end 62 abutting against the bar 31. The push member 6 is rotatable relative to the bar 31 so as to push the mounting seat 43. When the push member 6 is rotated to cause the end 61 of the push member 6 to push the mounting seat 43, the worm shaft 42 engages the worm gear 51, as best shown in FIG. 4. When the push member 6 is rotated in the reverse direction, the end 61 of the push member 6 is moved away from the mounting seat 43 so that one end of the mounting seat 43 falls by gravity onto the end 61 of the bolt 6, thereby disengaging the worm shaft 42 from the worm gear 51, as best shown in FIG. 6.

In use, the motor 41, which is connected electrically to a power source (not shown), is controlled to rotate clockwise or counterclockwise through an appropriate control switch or a remote control. The rotation of the worm shaft 42 follows that of the motor 41, and the worm gear 51 is rotated about the spindle 510 by the worm shaft 42, so that the lever 53, which rotates along with the worm gear 51, can bring the movable clamping rollers 52' toward or away from the fixed clamping rollers 52. When the movable clamping rollers 52' are moved toward the fixed clamping rollers 52, the user's ankles can be clamped between the fixed and movable clamping rollers 52, 52'. To permit release of the user's ankles from the fixed and movable clamping rollers 52, 52', the lever 53 must be rotated in the reverse direction to a predetermined inclination angle relative to the bar 31.

When the power source is malfunctioning, or provides an insufficient supply of power that renders the motor 41 incapacitated, and the user is using the inversion table 1 (see FIG. 1) and is in an inverted position with the user's ankles clamped between the fixed and movable clamping rollers 52, 52', the user can move first to a non-inverted position, after which the push member 6 is rotated so as to move the end 61 thereof away from the mounting seat 43. This permits one end of the mounting seat 43 to fall by gravity, thereby disengaging the worm shaft 42 from the worm gear 51. The movable clamping rollers 52' can then be manually pulled away from the fixed clamping rollers 52 to thereby release the user's ankles from between the clamping rollers 52, 52'.

It is worth mentioning that, in this embodiment, the motor 41 is disposed between the positioning plates 32 within the receiving space 33 so as to be hidden, so that the entire ankle-clamping device 2 occupies a minimum space, and has an enhanced outer appearance. Further, although the motor 41 is disposed on the right side, as shown in FIG. 4, the motor 41 may be disposed at the left side in an alternative embodiment. The worm shaft 42 may be similarly rotated.

From the aforementioned description, the advantages of the ankle-clamping device 2 of the present invention may be summarized as follows:

1. When power is supplied to the motor 41, through a control switch or a remote control, the rotating direction of the motor 41 can be controlled so as to move the movable clamping rollers 52' toward or away from the fixed clamping rollers 52 to thereby clamp or unclamp the user's ankles between the fixed and movable clamping rollers 52, 52'. Hence, operation of the present invention is easy and convenient.

2. Through the motor 41 and the worm shaft 42 of the drive mechanism 4, and in coordination with the worm gear 51 and the lever 53, the movable clamping rollers 52' can be rotated toward or away from the fixed clamping rollers 52 so as to clamp or unclamp the user's ankles therebetween. Hence, the present invention employs few components to achieve a clamping effect.

3. Through the push member 6, the worm shaft 42 can be moved toward or away from the worm gear 51 so as to engage or disengage with the same. Further, if power is not (or insufficiently) supplied to the motor 41 by the power source, the push member 6 can still be rotated relative to the bar 31 so as to move the end 61 thereof away from the mounting seat 43, thereby moving the worm shaft 42 away from the worm gear 51. Consequently, the movable clamping rollers 52' can be pulled manually away from the bar 31 so as to permit removal of the user's ankles from between the fixed and movable clamping rollers 52, 52'. When the supply of power to the motor 41 is normal, the push member 6 is again rotated relative to the bar 31 in such a manner that the end 61 thereof pushes the mounting seat 43 until the worm shaft 42 engages the worm gear 51. Hence, safety is provided in the use of the present invention.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An ankle-clamping device for an inversion table, comprising:

a clamp holder;

a drive mechanism including a motor mounted on said clamp holder, and a worm shaft rotated by said motor; and a clamping roller unit including a worm gear connected rotatably to said clamp holder and meshing with said worm shaft, a lever having one end connected to and rotatable along with said worm gear, a pair of fixed clamping rollers fixed to said clamp holder, and a pair of movable clamping rollers fixed to said lever, said movable clamping rollers being movable toward said fixed clamping rollers to cooperatively clamp therebetween the user's ankles, or away from said fixed clamping rollers to permit release of the user's ankles from therebetween.

2. The ankle-clamping device of claim 1, wherein said clamp holder includes a bar, and two positioning plates connected respectively to two opposite sides of said bar at one end thereof, said worm gear and said drive mechanism being connected pivotally to and being disposed between said positioning plates.

3. The ankle-clamping device of claim 1, wherein said drive mechanism further includes a mounting seat fulcrumed to said clamp holder and supporting said motor and said worm shaft, said ankle-clamping device further comprising a push member connected movably to said clamp holder to releasably push said mounting seat so as to make said worm shaft engage releasably said worm gear.

4. The ankle-clamping device of claim 3, wherein said push member is configured as a bolt threadedly connected to said clamp holder and being rotatable relative to said clamp holder to push said mounting seat to thereby engage said worm shaft with said worm gear, or to move away from said mounting seat to thereby permit said worm shaft to disengage from said worm gear.

* * * * *